United States Patent [19]

Dvorachek

[11] 4,250,361

[45] Feb. 10, 1981

[54] PRESSURE ACTUATED SWITCH WITH ACTUATOR HAVING CONTACT-ACTUATING RIB BETWEEN PISTON AND SPRING-GUIDE PORTIONS

[75] Inventor: Harold A. Dvorachek, Iola, Kans.

[73] Assignee: The Echlin Manufacturing Company, Branford, Conn.

[21] Appl. No.: 19,766

[22] Filed: Mar. 12, 1979

[51] Int. Cl.[3] ..... H01H 35/38

[52] U.S. Cl. ..... 200/82 R; 200/18; 200/81.4; 200/303

[58] Field of Search ..... 200/5 R, 6 BB, 6 C, 200/18, 81 R, 81.4, 82 R, 82 D, 153 LA, 159 A, 246, 283, 302, 303, 360, 340

[56] References Cited

U.S. PATENT DOCUMENTS

| | | | |
|---|---|---|---|
| 3,321,594 | 5/1967 | Reise | 200/81.4 |
| 3,519,773 | 7/1970 | Klimek | 200/83 J |
| 3,601,568 | 8/1971 | Sorenson | 200/303 |
| 3,784,765 | 1/1974 | Daly | 200/5 R |
| 3,900,709 | 8/1975 | Sheesley | 200/5 R |
| 4,046,975 | 9/1977 | Seeger, Jr. | 200/306 |

*Primary Examiner*—Gerald P. Tolin

*Attorney, Agent, or Firm*—Neuman, Williams, Anderson & Olson

[57] ABSTRACT

A switch is provided including an actuating member having a piston portion at one end responsive to applied fluid pressure, a guide portion at its opposite end encompassed by a coiled compression spring, and having an intermediate annular rib engageable with inwardly projecting tabs of actuately extending contact plates. Each of two of the contact plates has a contact selectively engageable with a corresponding contact on the third contact plate in response to movement of said actuating member.

9 Claims, 4 Drawing Figures

PRESSURE ACTUATED SWITCH WITH ACTUATOR HAVING CONTACT-ACTUATING RIB BETWEEN PISTON AND SPRING-GUIDE PORTIONS

BACKGROUND OF THE INVENTION

This invention relates to a pressure actuated switch and more particularly to a pressure actuated switch which is rugged, durable, and highly reliable, while having a comparatively simplified construction and being economically manufacturable.

Pressure actuated switches of various types have been employed in numerous applications where the pressure condition of a pressure source or line must be converted to an electrical signal. Exemplary of existing pressure switches are those disclosed in the following patents: U.S. Pat. No. 2,928,913 issued to H. L. Dobrikin on Mar. 15, 1960; U.S. Pat. No. 2,935,581 issued to H. L. Dobrikin on May 3, 1960; U.S. Pat. No. 3,093,716 issued to C. Horowitz on June 11, 1963; U.S. Pat. No. 3,177,313 issued to B. Klimek on Apr. 6, 1965; U.S. Pat. No. 3,240,895 issued to C. Horowitz and B. Klimek on Mar. 15, 1966; U.S. Pat. No. 3,519,773 issued to B. Klimek on July 7, 1970; and U.S. Pat. No. 3,529,107 issued to H. L. Dobrikin on Sep. 15, 1970.

Pressure actuated switches may include an actuating member which is carried by or part of a diaphragm, piston or other means operated by fluid pressure thereagainst, spring means being provided for urging the actuating member in one direction. Various types of housing and contact arrangements may be employed. In one arrangement, a housing is formed from a pair of members which have rim portions secured together by suitable means, with electrical contacts being secured to one of such members which may also carry the spring means of the switch. In one type of contact arrangement, a contact is carried by an actuating member for movement into and out of engagement with a fixed contact or fixed contacts.

Such arrangements as well as others are generally satisfactory but may be more difficult and expensive to manufacture than would be desirable. Accordingly, it is an object of this invention to provide an improved pressure actuated switch which is highly reliable in operation while being readily and economically manufacturable.

Another object of the invention is to provide a switch construction in which desired alternative switching actions can be readily obtained.

In an illustrative embodiment of a switch constructed in accordance with this invention, first and second resilient contact plates have portions engaged with planar surface portions of a housing, such surface portions being disposed approximately in a common plane transverse to a central axis, in radially spaced relation to the central axis and in arcuately spaced relation to each other. The contact plates have overlapping end portions which carry first and second interengagable contacts and an actuating member is movable along the central axis and has a portion projecting outwardly to engage a portion of one of the plates and to control deflection thereof and interengagement of the contacts.

This arrangement simplifies the construction of a switch and has other advantages. Preferably, the actuating member has a radially outwardly projecting annular rib for engagement with a radially inwardly projecting tab portion of one of the contact plates.

An additional contact plate may be provided which has a portion engaged with another planar surface portion of the housing, disposed approximately in the same common plane as the first and second contact plates and in arcuately spaced relation to the other surface portions and in radially spaced relation to the axis. The additional contact plate and one of the first and second plates have interengagable contacts. By appropriate dimensions either a make-before-break or a break-before-make action may be obtained, as desired.

In accordance with further specific features, the actuating member has an integral piston portion projecting therefrom in one axial direction, preferably having a reduced diameter end portion receiving an O-ring seal member. The actuating member further has an integral portion projecting axially therefrom in the opposite direction and into the center of a coiled compression spring, serving to act as a spring guide.

An additional very important feature relates to the provision of terminal posts which extend in directions parallel to the central axis of the switch and which have base portions extending through arcuately spaced openings in an annular rim portion of one housing member, thence through openings in contact plates, and thence through openings in an annular rim portion of a second housing member, the terminal ends of such base portions being provided with rivet means to secure the rim portions together and to clamp the contact plates in position. This arrangement is highly advantageous, not only in simplifying assembly but also in insuring the proper assembly of the switch in a manner such as to obtain reliable switching action.

This invention contemplates other objects, features and advantages which will become more fully apparent from the following detailed description taken in conjunction with the accompanying drawings.

DESCRIPTION OF A PREFERRED EMBODIMENT

Figure 1:
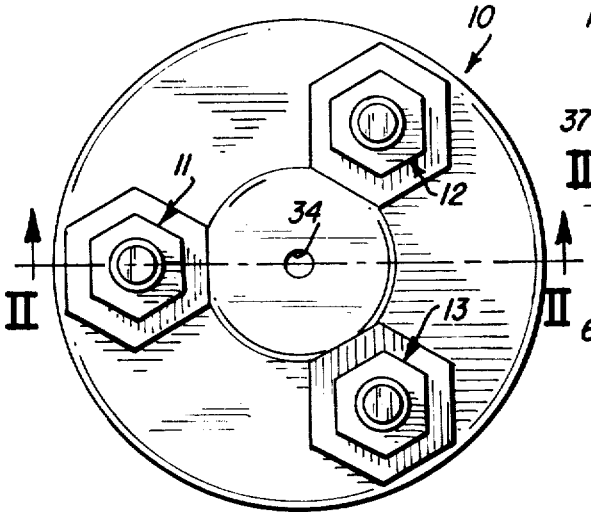
FIG. 1 is a top plan view of a switch constructed in accordance with the principles of this invention.

In the drawings, reference numeral 10 generally designates a pressure actuated switch constructed in accordance with the principles of this invention. The switch 10 includes three electrical terminal posts 11, 12 and 13 which have threaded portions projecting from a peripheral rim portion 14 of a cap member 15. The terminal posts 11, 12 and 13 have parallel axes at equal radial spacings from a central axis of the switch and in equiangularly spaced relation to each other. A body member 16 is provided having a peripheral rim portion 17 secured to the rim portion 14 of cap member 15 and having an externally threaded sleeve portion 18 for coupling the switch 10 to a source of fluid pressure.

Contacts within the switch 10 are operative to connect the terminal post 11 to the terminal post 12 when the pressure applied to the switch is greater than a predetermined level and to connect the terminal post 11 to the terminal post 13 when the pressure is less than such level. The switch may be used, for example, in a pneumatic braking system of a truck or in other similar applications, reliability being very important.

An actuating member 20 is provided including a piston portion 21 having an external cylindrical surface in sliding engagement with an internal cylindrical surface 22 of the body member 16 and having a reduced diameter terminal end part 23 on which an O-ring seal member 24, of relative elongate cross-section, is disposed. The body member 16 has an end wall 25 from which the externally threaded coupling sleeve portion 18 extends, a passage 26 being provided in the sleeve portion 18 and end wall 25 for admission of fluid under pressure to act on the piston portion 21. It is noted that four stand-off projections 27 may be provided on the end face of the piston portion 21 for engagement with the end wall 25. It is also noted that the actuating member 20 may have hollowed-out portions as illustrated to reduce weight and the amount of material required to form the same. The actuating member 20 as well as the cap and body members 15 and 16 are preferably formed of a molded plastic material.

The actuating member 20 further includes a spring guide portion 29, at its distal end, about which a coiled compression spring 30 is positioned. The spring acts between one end of the piston portion 21 and an end wall portion 31 which is at the upper end of a sleeve portion 32 of the cap member 15. Spring 30 urges the piston portion toward the end wall 25, acting in opposition to the pressure of fluid against the lower end of the piston portion 21. The end wall 31 is formed with a central internal recess 33 which receives the end of the spring guide portion 29 and is also formed with a vent opening 34.

The actuating member 20 additionally includes an annular radially outwardly projecting rib 36, positioned intermediate to the ends of the member 20, for controlling operation of contacts of the switch. In the illustrated arrangement, three resilient contact plates 37, 38 and 39 are provided, respectively connected electrically to the terminal posts 11 through 13. The plates 37, 38 and 39 have portions which are clamped between the lower co-planar surfaces of three support pad portions 40, 41 and 42 of the cap member 15 and upper co-planar surface portions of three support pad portions 43, 44 and 45 of the body member 16. To insure a low-resistance reliable electrical connection to the terminal posts 11, 12 and 13, the contact plates 37, 38 and 39 preferably have integral finger portions 37*a*, 38*a* and 39*a* extending into openings in the support pad portions 40, 41 and 42 and in tight pressure engagement with shank portions of the terminal posts 11, 12 and 13.

Contact plates 37 and 38 have cooperating portions 47 and 48 which extend arcuately away from the supported portions thereof and which overlap and carry interengagable contacts 49 and 50. The portion 48 of plate 38 is of greater arcuate length and it is formed with a radially inwardly projecting tab portion 51 which is engaged by the underside of the annular rib 36 of the actuating member 20 to bend the portion 48 of plate 38 downwardly and to hold the contact 50 below the contact 49 in the illustrated condition of the switch.

When fluid pressure is applied, sufficient to overcome the force of the spring 30, the actuating member 20 together with the rib portion 36 thereof are moved upwardly to allow the portion 48 of plate 38 to move upwardly and to engage the contact 50 with the contact 48 and thereby electrically connect the terminal posts 11 and 12.

In a similar fashion, the contact plate 37 and the contact plate 39 have cooperating arcuately extending portions 53 and 54 which are similar to portions 47 and 48 and which overlap and carry interengaged contacts 55 and 56, the portion 54 being of greater arcuate length and being formed with a radially inwardly projecting tab portion 57 which is positioned above the annular rib portion 36 of actuating member 20. In the illustrated condition, the contacts 55 and 56 are engaged, but when the actuating member 20 together with the rib portion 36 thereof are moved upwardly, in response to fluid pressure sufficient to overcome the force of spring 30, the contact 56 is moved upwardly out of engagement with the contact 55.

It is noted that in the illustrated construction, the contact plates 38 and 39 have additional portions 59 and 60 projecting toward each other and having ends formed with recesses to receive integral pin portions 61 and 62 of the cap member 15, serving to locate and position the contact plates 38 and 39 relative to the cap member 15 during and after assembly.

Figure 2:
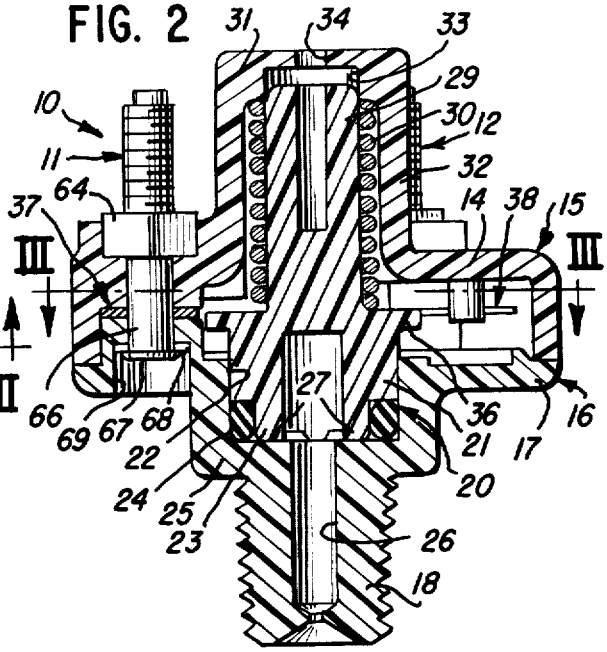
FIG. 2 is an elevational sectional view taken substantially along line II—II of FIG. 1.
Figure 3:
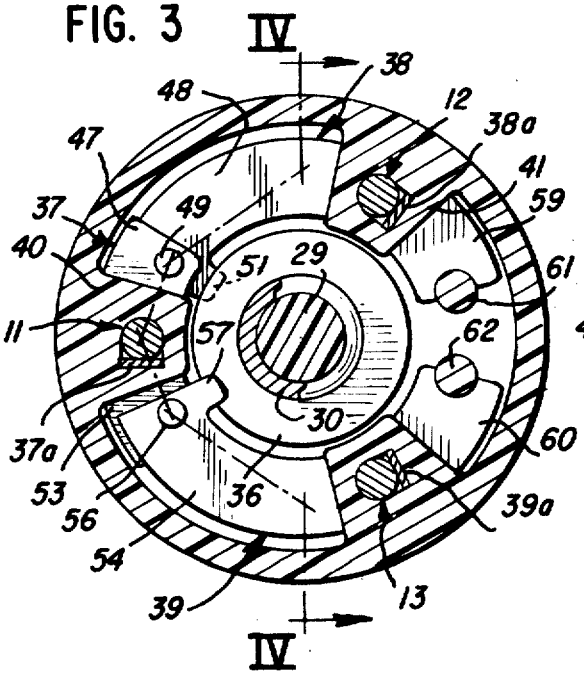
FIG. 3 is a sectional view taken substantially along line III—III of FIG. 2.
Figure 4:
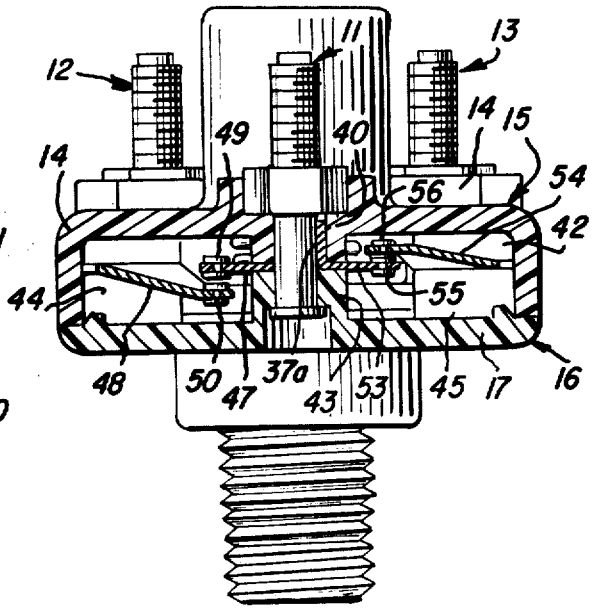
FIG. 4 is a sectional view taken substantially along line IV—IV of FIG. 3.

In accordance with important features of the invention, the terminal posts 11, 12 and 13 have base portions which are used in holding the cap and base members 15 and 16 together in the assembled condition of the switch 10. As shown in FIGS. 2 and 3, terminal post 11 has a base portion including a portion 64 of hexagonal shape seated in a recess of the same shape in the rim portion 14 of cap member 15, a cylindrical shank portion 66 extending through an opening in the support pad portion 40 of cap member 15 and through openings in the contact plate 37 and in the pad and rim portions 43 and 17 of body member 16, and a terminal head portion 67 formed by a riveting operation. A washer 68 is engaged by the head portion 67 and is disposed in the inner end of a recess 69 in the rim and pad portions 17 and 43 of the body member 16.

Each of the other two terminal posts 12 and 13 have the same construction, including terminal head portions formed by a riveting operation, with washers like the washer 68 being provided, disposed in recesses like the recess 69.

For assembly of the switch 10, a suitable jig is provided for receiving the cap member 15 and the posts 11, 12 and 13 to position the posts relative to the cap member 15. Then contact plates 37 and 39 may be placed in position on posts 11 and 13 and against the planar surfaces of pads 40 and 42 after which the actuating member 20 together with the spring 30 may be installed and held by suitable means. Then the contact plate 38 may be installed after which the body member 16 is installed. Finally, the washer 68 and the corresponding washers for the other two terminal posts are installed, with a riveting operation being then performed to form the terminal head portions on the three terminal posts.

It is noted that in the illustrated construction, three terminal posts are used with a single pole, double throw operation being obtained and it is also noted that with the illustrated dimensioning of the parts, a make-before-break type of operation is obtained, the contacts 49 and 50 being engaged before the contacts 55 and 56 are disengaged. By changing the dimensioning, however, a break-before-make operation can be obtained. It is also possible to have a simplified switch in which one of the contact plates 38 or 39 is removed and in which the threaded portion of the corresponding terminal post is also removed.

It is noted that the contact plates 37, 38 and 39 are readily formed by stamping operations and are substantially flat before assembly in the switch, with the exception of finger portions 37*a*, 38*a* and 39*a* and with the exeption of the respective tabs 51 and 59 which may be angularly displaced somewhat. The contacts 49, 50, 55 and 56 are secured to the plates 37 through 39 through riveting operations. Various features of the construction make it difficult to improperly assemble the switch. For example, the finger portions of contact plates 38 and 39 extend in directions such that they cannot be improperly placed. The contact plate 37 with the contacts 49 and 55 thereon is the same regardless of which side is up and cannot be improperly assembled. Such features and the simplified way in which the switch is assembled not only reduce the cost of manufacture of the switch but contribute to insuring that the switch will be reliable and troublefree in operation, with a long operating life.

It will be understood that modifications and variations may be affected without departing from the novel concepts of this invention. Moreover, while this invention has been disclosed in terms of an illustrative embodiment, the invention is not so limited; rather the invention encompasses the true spirit and scope of the attached claims.

What is claimed is:

1. In a pressure actuated switch, housing means having a central axis and including first and second planar support surface portions disposed approximately in a common plane transverse to said central axis and disposed in radially spaced relation to said axis and in arcuately spaced relation to each other, first and second resilient contact plates having portions engaged with said first and second support surface portions and having overlapping end portions, first and second interengageable contacts on said overlapping end portions of said first and second contact plates, an actuating member supported for axial movement in said housing means, said actuating member and one of said first and second contact plates having interengageable portions for controlling deflection of the end portion of said one of said first and second contact plates and thereby controlling engagement of said first and second contacts in response to axial movement of said actuating member, said housing means having a first end wall portion and an opposite second end wall portion, each of said first and second end wall portions being generally transverse to said central axis, said housing means further including side wall portions defining first and second internal cylindrical surfaces respectively adjacent said first and second end wall portions and having axes coincident with said central axis, said actuating member including a first cylindrical portion quided by said first cylindrical surface, an annular surface portion facing said second end wall portion and a second cylindrical portion extending away from said annular surface and within said second cylindrical surface, and a coiled compression spring engaged between said annular surface and said second end wall and disposed in surrounding relation to said second cylindrical portion of said actuating member and within said second cylindrical surface of said housing means, said actuating member further having a rib portion extending radially outwardly with respect to said annular surface portion, and said one of said contact plates having a tab portion extending radially inwardly for engagement with said radially outwardly extending rib portion of said actuating member.

2. In a switch as defined in claim 1, said tab portion extending radially inwardly along a plane through said central axis and approximately aligned with said first and second contacts.

3. In a switch as defined in claim 1, said housing means including a third planar support surface portion disposed approximately in said common plane of said first and second surface portions and disposed in radially spaced relation to said common axis and in arcuately spaced relation to said first and second surface portions, a third resilient contact plate having a portion engaged with said third support surface portion, said third contact plate and said first contact plate having overlapping end portions, third and fourth interengageable contacts on said overlapping end portions of said third and first contact plates, and said actuating member and one of said first and third contact plates having interengageable portions for controlling deflection of the end portion of said one of said first and third contact plates and thereby controlling engagement of one of said third and fourth contacts in response to axial movement of said actuating member.

4. In a switch as defined in claim 1, said first cylindrical portion of said actuating member defining a piston portion having an external cylindrical surface in slidable engagement with said first internal cylindrical surface of said housing means, and said end wall portion of said housing means having an opening for fluid communication with the space between the end of said piston portion and said end wall portion.

5. In a switch as defined in claim 4, said piston portion having a reduced diameter terminal end, and a seal ring around said reduced diameter terminal end of said piston portion.

6. In a pressure actuated switch, housing means having a central axis and including first and second planar support surface portions disposed approximately in a common plane transverse to said central axis and disposed in radially spaced relation to said axis and in arcuately spaced relation to each other, first and second resilient contact plates having portions engaged with said first and second support surface portions and having overlapping end portions, first and second interengageable contacts on said overlapping end portions of said first and second contact plates, an actuating member supported for axial movement in said housing means, said actuating member and one of said first and second contact plates having interengageable portions for controlling deflection of the end portion of said one of said first and second contact plates and thereby controlling engagement of said first and second contacts in response to axial movement of said actuating member, said housing means comprising first and second housing members having peripheral rim portions, said first and second planar support surface portions being provided on one of said first and second housing members and the engaged portions of said first and second contact plates being clamped directly between and by said peripheral rim portions, and first and second terminal posts projecting from said first housing member and having base portions extending through the peripheral rim portion of said first housing member, thence through said first and second contact plates and thence through the peripheral rim portion of said second housing member to terminal ends, and securing means on said terminal ends of said base portions of said terminal posts.

7. In a switch as defined in claim 6, said securing means being in the form of rivet means.

8. In a pressure actuated switch, housing means having a central axis and including first and second planar support surface portions disposed approximately in a common plane transverse to said central axis and disposed in radially spaced relation to said axis and in arcuately spaced relation to each other, first and second resilient contact plates having portions engaged with said first and second support surface portions and having overlapping end portions, first and second interengageable contacts on said overlapping end portions of said first and second contact plates, an actuating member supported for axial movement in said housing means, said actuating member and one of said first and second contact plates having interengageable portions for controlling deflection of the end portion of said one of said first and second contact plates and thereby controlling engagement of said first and second contacts in response to axial movement of said actuating member, said housing means having first and second openings throughout said first and second support surface portions thereof, said first and second contact plates having openings therein aligned with said first and second openings in said housing means, and first and second terminal posts having shank portions extending through said first and second openings in said housing means and through said openings in said first and second contact plates, and said first and second contact plates having integral resilient portions extending into said first and second openings in said housing means and firmly engaged with said shank portions of said first and second terminal posts.

9. In a switch as defined in claim 8, said integral resilient portions being in the form of fingers.

* * * * *